US007342145B2

(12) United States Patent
Wu et al.

(10) Patent No.: US 7,342,145 B2
(45) Date of Patent: Mar. 11, 2008

(54) PROCESS FOR REFINING LIQUEFIED PETROLEUM GAS IN A COMMERCIAL SCALE

(75) Inventors: Qing Wu, Beijing (CN); Zhenyi Liu, Beijing (CN)

(73) Assignee: Beijing SJ Environmental Protection and New Material Co., Ltd., Beijing (CN)

( * ) Notice: Subject to any disclaimer, the term of this patent is extended or adjusted under 35 U.S.C. 154(b) by 608 days.

(21) Appl. No.: 10/495,250

(22) PCT Filed: Nov. 12, 2002

(86) PCT No.: PCT/CN02/00806

§ 371 (c)(1),
(2), (4) Date: Oct. 8, 2004

(87) PCT Pub. No.: WO03/042339

PCT Pub. Date: May 22, 2003

(65) Prior Publication Data

US 2005/0038309 A1 Feb. 17, 2005

(30) Foreign Application Priority Data

Nov. 13, 2001 (CN) ..... 01 1 34688

(51) Int. Cl.

| | |
|---|---|
| ***C07C 7/12*** | (2006.01) |
| ***C10G 17/00*** | (2006.01) |
| ***C10G 19/00*** | (2006.01) |
| ***B01J 21/18*** | (2006.01) |

(52) U.S. Cl. ..... 585/820; 585/822; 585/823; 208/208 R; 208/228; 208/229; 208/244; 208/249; 502/182; 502/185

(58) Field of Classification Search ..... 208/208 R, 208/226, 228, 229, 244, 249; 585/822, 823, 585/820; 502/182, 185
See application file for complete search history.

(56) References Cited

U.S. PATENT DOCUMENTS 3,725,252 A * 4/1973 Maier ..... 208/213

(Continued)

FOREIGN PATENT DOCUMENTS

CN 1194294 A 9/1998

(Continued)

*Primary Examiner*—Glenn Caldarola
*Assistant Examiner*—Huy-Tram Nguyen
(74) *Attorney, Agent, or Firm*—Berenato, White & Stavish

(57) ABSTRACT

The present invention relates to a novel process for refining the liquefied petroleum gas (LPG) in a commercial scale. The process comprises: sequentially performing fine desulfurization and mercaptan conversion of the LPG after alcohol amine treatment through desulfurizer and catalyst set in fixed bed reactor in the absence of alkali, wherein, during the fine desulfurization, the resultants of reaction between hydrogen sulfide in the LPG and Fe—Ca oxides or their hydrates adhered on the desulfurizer, and during the mercaptan conversion, the mercaptan in the LPG reacts with the residual trace amount of air in the LPG under the action of the catalyst to produce the disulfides; letting the formed disulfides along with the LPG flow out of the fixed bed reactor; rectifying the LPG after the mercaptan conversion to obtain the refined LPG products, with further rectification to obtain the valuable disulfide products. The present process has advantages of high efficiency, no alkali discharge, being a simplified process over the prior method using alkali treatment and making no environmental pollution.

10 Claims, 3 Drawing Sheets

U.S. PATENT DOCUMENTS 3,785,964 A * 1/1974 Chun et al. ..... 208/191
4,039,389 A * 8/1977 Christman ..... 196/14.52
4,040,947 A * 8/1977 Christman ..... 208/235
4,256,728 A * 3/1981 Nishino et al. ..... 422/4
4,313,820 A * 2/1982 Farha et al. ..... 208/213
4,381,993 A * 5/1983 Nevitt ..... 208/217
4,383,916 A * 5/1983 Gutberlet et al. ..... 208/189
4,391,633 A * 7/1983 Yamauchi et al. ..... 75/565
4,626,341 A * 12/1986 Verachtert ..... 208/235
4,753,722 A * 6/1988 Le et al. ..... 208/207
4,913,797 A * 4/1990 Albinson et al. ..... 208/89
5,064,525 A * 11/1991 Frame et al. ..... 208/193
5,068,477 A * 11/1991 Berrebi ..... 585/274
5,169,516 A * 12/1992 Carr ..... 208/189
5,320,742 A * 6/1994 Fletcher et al. ..... 208/89
5,413,701 A * 5/1995 Gillespie et al. ..... 208/189
5,659,106 A 8/1997 Frey et al.
5,741,415 A * 4/1998 Mazgarov et al. ..... 208/195
5,846,406 A * 12/1998 Sudhakar et al. ..... 208/216 R
5,868,921 A * 2/1999 Barre et al. ..... 208/57
6,248,230 B1 * 6/2001 Min et al. ..... 208/213
6,306,288 B1 * 10/2001 Pittman et al. ..... 208/235
6,495,029 B1 * 12/2002 Schorfheide et al. ..... 208/213
6,946,111 B2 * 9/2005 Keller et al. ..... 423/576.2

FOREIGN PATENT DOCUMENTS

CN 1196971 10/1998
CN 1229005 9/1999
DE 195 25 190 A1 1/1997
JP 47-30162 8/1972

* cited by examiner

PROCESS FOR REFINING LIQUEFIED PETROLEUM GAS IN A COMMERCIAL SCALE

TECHNICAL FIELD OF THE INVENTION

This invention belongs to the field of refining liquefied petroleum gas, and in particular relates to a process for removing sulfur-containing compound from liquefied petroleum gas (LPG) in a commercial scale in the absence of alkali.

BACKGROUND ART OF THE INVENTION

During the oil refining, the LPG before being refined contains a certain amount of sulfides, including inorganic sulfides such as hydrogen sulfide, element sulfur, etc., and organic sulfides such as mercaptans, disulfides, thiophene, etc., wherein the primary active sulfides such as hydrogen sulfide and mercaptans, and nascent-state element sulfur have strong corrosivity, odor and toxicity. In addition, during the process of using the product, these sulfides may be converted into strongly corrosive, toxic and harmful substances, such as sulfur dioxide, sulfur trioxide and the like, which seriously pollute environment and impair human health. Even if the product is used as an intermediate product, the sulfides in trace quantities may result in catalyst poisoning, apparatus corrosion and many other problems. Moreover, the presence of these impurities may result in that LPG cannot pass the copper sheet corrosion test, so that the quality of the product cannot reach the grade as set forth in the national standard and the normal production and the improvement of economic benefit are hereby adversely affected.

At present, the home and oversea processes for refining LPG comprise two procedures: desulfurization and deodorization. The desulfurization procedure generally comprises removing hydrogen sulfide in the LPG obtained by catalytic cracking, delayed coking and hydrogen cracking with alcohol amine solvents, such as monoethanolamine, diethanolamine, N-methyldiethanolamine or diisopropanolamine (hereinafter referred to as alcohol amine treatment). Under the appropriate operation conditions, the level of the residual hydrogen sulfide could be reduced to a trace amount. After alcohol amine treatment, the LPG still generally contains a trace amount of hydrogen sulfide, and, if not removed, it may inactivate the catalyst used in the deodorization procedure and adversely affect the refining effect and the product quality. Thus, the deodorization procedure comprises two steps: one step is to further remove hydrogen sulfide from the LPG treated with the above alcohol amine by prewashing with alkali (generally, sodium hydroxide solution) (also referred to as fine-desulfurization, where hydrogen sulfide reacts with sodium hydroxide to form sodium sulfide), and the alkali solution after the prewashing is recycled and replaced when sodium sulfide therein reaches a certain level; and the other step is to carry out mercaptan conversion of the LPG prewashed with the alkali solution. The method of mercaptan conversion of LPG was firstly proposed by UOP in 1958, and has evolved into the current well-developed liquid-liquid extraction-catalytic oxidization technology. The basic process of said technology comprises dissolving polymeric phthalocyanine cobalt or sulphonated phthalocyanine cobalt as catalyst in sodium hydroxide solution, sufficiently mixing and reacting with LPG in a tower or container, wherein the mercaptans in the LPG react with sodium hydroxide to generate sodium mercaptides that consequently enter the catalyst alkali solution. The reaction equation is:

$$RSH+NaOH \rightarrow RSNa+H_2O$$

The catalyst alkali solution carrying sodium mercaptides is mixed with air and then enters an oxidization tower to generate disulfides according to the following reaction equation:

$$4RSNa+O_2+2H_2O \rightarrow 2RSSR+4\ NaOH$$

The disulfides are separated from the catalyst alkali solution by sedimentation in a separating tank, wherein the alkali solution is recycled. However, in practice, the disulfides still substantively remain in the catalyst alkali solution during the above separation, because its commercial-scale process is a continuous process.

It can be seen that the alkali solution used for the prewashing must be frequently replaced during the deodorization, even several times per day. The disulfides formed by oxidizing sodium mercaptides essentially remain in the catalyst alkali solution, so that the catalyst alkali solution must be replaced for ensuring the sulfur content of LPG lower than the standard, after it treated a certain quantity of LPG. Thus, a great quantity of waste alkali solution is generated during the deodorization procedure, and to treat said waste alkali solution (commonly called as alkali sludge) constitutes a heavy burden for oil refining enterprises. The treatment of alkali sludge before discharge generally is a complex and costly process, and often makes secondary pollution. Secondly, the tail gas generated during the mixing and subsequent reaction of sodium-mercaptide containing catalyst alkali solution with air in the oxidization tower not only results in serious environment pollution (as one of the major sources of odors in plant area), but also leads to the lose of materials. Thirdly, said technology uses relatively complex apparatus and process and has higher operation cost.

CN1194294A discloses an alkali-free deodorization process for production of aviation kerosene, comprising mixing raw aviation kerosene with activating agent solution, and passing through a catalyst bed together with air for desulfurization, wherein the catalyst is sulphonated phthalocyanine cobalt. DE19525190A1 discloses a method for removing mercaptans from hydrocarbon distillates such as crude oil distillates, gasoline, kerosene and diesel oil by oxidization, which process comprises converting mercaptans into disulfides with an oxidizing agent in the presence of metal catalyst on carbon fiber fabrics, wherein the used heterogeneous catalyst comprise water-soluble inorganic salts of Cu, Fe, Ni and/or Co, and oxides of Ca, Si, Cu, Mg, Mn, Fe, Zn and/or Al. JP Sho 47-30162B discloses a method of converting mercaptans into disulfides via oxidization. U.S. Pat. No. 5,659,106 discloses a method for removing mercaptans and olefins from petroleum stock by catalytic distillation. CN 1196971 discloses a desulfurizer and a process for preparing the same, wherein the desulfurizer uses $Ca_2Fe_2O_5$ as its effective component, which can be used for removing hydrogen sulfide from the chemical raw gas derived from coal or petroleum. However, all these documents neither mention the fine desulfurization of LPG by a fixed bed reaction method, nor mention the mercaptan conversion of LPG by a fixed bed catalytic oxidization method.

DESCRIPTION OF THE INVENTION

The main object of the invention is to provide a process for effectively refining LPG in a commercial scale, said process producing relatively small quantity of the gaseous, liquid and solid wastes to be treated, and having high utilization rate of raw materials. The further object of the present invention is to obtain disulfide products during the procedure of refining LPG.

The general technical concept of the present invention is: greatly changing the current industrial deodorization procedure; using a fixed bed reaction method to perform the fine desulfurization of LPG after the alcohol amine treatment, so as to replace the current fine desulfurization technology via prewashing with sodium hydroxide solution; using a fixed bed catalytic oxidization method to perform the mercaptan conversion of LPG, so as to replace the current mercaptan conversion procedure, that is, the liquid-liquid extraction-catalytic oxidization technology; separating the disulfides-containing LPG after the mercaptan conversion, so as to obtain refined LPG products and a mixture containing disulfides. If the mixture containing disulfides is further separated, valuable disulfide products can be obtained.

The basic technical solution for achieving the main object of the invention is that the LPG after alcohol amine treatment passes through the desulfurizer and the catalyst set in a fixed bed reactor for performing fine desulfurization and mercaptan conversion in turn, wherein the hydrogen sulfide in the LPG reacts with Fe—Ca oxide or Fe—Ca oxide hydrate and the resultants adhere on the desulfurizer during the fine desulfurization, and the mercaptans in the LPG react with the residual trace amount of air in the LPG in the presence of catalyst to form disulfides during the mercaptan conversion, and the formed disulfides together with the LPG flow out of the fixed bed reactor; the LPG after mercaptan conversion is treated by rectification to obtain the refined LPG product; the desulfurizer comprises a Fe—Ca oxide or a Fe—Ca oxide hydrate as its effective component, and the catalyst comprises a Fe—Ca oxide or a Fe—Ca oxide hydrate as its active component.

The first embodiment of the present invention is that: on the basis of the aforesaid basic technical solution, the fine desulfurization and mercaptan conversion are conducted in different fixed bed reactors; the LPG after alcohol amine treatment first enters the preceding stage fixed bed reactor with a desulfurizer bed, where the LPG passes through the desulfurizer bed from bottom to top for the fine desulfurization; the LPG after the fine desulfurization enters into the subsequent stage fixed bed reactor with catalyst bed, where the LPG passes through the catalyst bed from bottom to top for the mercaptan conversion; and the mixture containing disulfide and LPG after the mercaptan conversion is separated by a rectification tower to obtain the refined LPG product from the tower top and the mixture containing disulfide from the tower bottom.

In the above first embodiment, the inlet concentration of hydrogen sulfide in the LPG during the fine desulfurization is less than or equal to 1000 ppm, preferably less than or equal to 100 ppm; the preferable fixed bed reactor is a fixed bed desulfurization tower in which a solid desulfurizer bed is set on the fixed bed of said desulfurization tower; the operation conditions of the fine desulfurization include: a temperature of 10 to 100° C., preferably from atmospheric temperature or 30 to 60° C., a pressure (gauge pressure) of 0.4 to 2.5 MPa, preferably 0.8 to 1.8 MPa, a liquid space rate of 1 to 2 $h^{-}$, a desulfurizer loading height of less than or equal to 10 m, and a ratio of height to diameter of 3:1 to 6:1. When the LPG flows through the desulfurizer bed of the fixed bed desulfurization tower from bottom to top, hydrogen sulfide reacts with the desulfurizer and the resultants adhere on the desulfurizer so that the hydrogen sulfide in the LPG is fully removed. After running for a period of time, and when hydrogen sulfide appears in the LPG after the fine desulfurization, that is, the desulfurizer becomes invalid, the desulfurizer must be replaced. According to the calculation, the replacement period is generally not shorter than six months.

The present invention uses a highly effective desulfurizer to fully remove hydrogen sulfide in the LPG. The suitable desulfurizer has an effective component of a Fe—Ca oxide or a Fe—Ca oxide hydrate, wherein the Fe—Ca oxide is preferably $2CaO.Fe_2O_3$ or $Ca_2Fe_2O_5$; the Fe—Ca oxide hydrate is preferably $3CaO.Fe_2O_3.6H_2O$ or $Ca_3(FeO_3)_2.6H_2O$; and $Ca_3(FeO_3)_2.6H_2O$ is the more preferable between $Ca_2Fe_2O_5$ and $Ca_3(FeO_3)_2.6H_2O$. The amount of the effective component is greater than 80% (i.e., from 80% to 100%) based on the total weight of desulfurizer, preferably from 85% to 95%, and more preferably from 91% to 95%. The desulfurizer may further comprise other components, mainly CaO. During the fine desulfurization, the resultants of the reaction between hydrogen sulfide and $Ca_2Fe_2O_5$ or $Ca_3(FeO_3)_2.6H_2O$ are mainly sulfur, ferrous sulfide and intergrowth product of ferrous sulfide and sulfur.

When $Ca_2Fe_2O_5$ is the effective component, the specifications and characteristics of the preferable desulfurizer are as follows:

| | |
|---|---|
| Appearance: | Strip shape, chocolate brown or yellowish brown |
| Size (mm) | Φ3-5 × 5-25 |
| Bulk density (g/ml) | 1.0-1.1 |
| Specific surface area ($m^2/g$) | 1.8-10 |
| Void ratio (%) | 40-65 |
| Side compress strength (N/cm) | ≧100 |
| Penetration sulfur capacity (wt %) | ≧30 |

When $Ca_3(FeO_3)_2.6H_2O$ is the effective component, the specifications and characteristics of the preferable desulfurizer are as follows:

| | |
|---|---|
| Appearance: | Strip shape, brown |
| Size (mm) | Φ2-4 × 5-25 |
| Bulk density (g/ml) | 1.1-1.2 |
| Specific surface area ($m^2/g$) | 1.8-10 |
| Void ratio (%) | 40-60 |
| Side compress strength (N/cm) | ≧80 |
| Penetration sulfur capacity (wt %) | ≧30 |

In the above first embodiment, during the mercaptan conversion, the fixed bed reactor is preferably a fixed bed catalytic reactor in which a solid catalyst bed is set on the fixed bed of said catalytic reactor, and the inlet concentration of mercaptan in the LPG after the fine desulfurization is less than or equal to 10000 ppm. The operation conditions of the mercaptan conversion include: a temperature of 0 to 100° C., preferably from atmospheric temperature or 30 to 60° C., a pressure (gauge pressure) of 0.4 to 2.3 MPa, preferably 0.7 to 1.6 MPa, a liquid space rate of 1 to 4 $h^{-1}$, a catalyst loading height of less than or equal to 10 m, and a ratio of height to diameter of 3:1 to 6:1. When the LPG flows through the catalyst bed of the fixed bed from bottom to top, under the action of the catalyst, an oxidation reaction takes place between the mercaptans in the LPG and the residual trace amount of air (or called as dissolved oxygen) in the LPG to form disulfides (thioethers), and said disulfides together with the LPG flow out of the fixed bed catalytic reactor. After running for a period a time, and when the LPG flowing out of the fixed bed catalytic reactor fails to pass the Doctor test or to pass the corrosion test of copper sheet, that is, the catalyst becomes inactivated, the catalyst must be replaced. According to the calculation, the replacement period is generally not shorter than two years.

The present invention uses a highly effective catalyst to fully convert the mercaptans in the LPG. The suitable catalyst has an active component of a Fe—Ca oxide or a Fe—Ca oxide hydrate, wherein the Fe—Ca oxide is preferably $2CaO.Fe_2O_3$; the Fe—Ca oxide hydrate is preferably $3CaO.Fe_2O_3.6H_2O$; and $3CaO.Fe_2O_3.6H_2O$ is the more preferable between $2CaO.Fe_2O_3$ and $3CaO.Fe_2O_3.6H_2O$. The amount of the active component is greater than 80% (i.e., from 80% to 100%) based on the total weight of the catalyst, preferably from 85% to 95%, and more preferably from 91% to 95%. The catalyst may further comprise other components, mainly CaO.

When $2CaO.Fe_2O_3$ is used as the active component, the specifications and characteristics of the preferable catalyst are as follows:

| | |
|---|---|
| Appearance: | Strip shape, chocolate brown or yellowish brown |
| Size (mm) | Φ3-5 × 5-25 |
| Bulk density (g/ml) | 1.0-1.1 |
| Specific surface area ($m^2$/g) | 1.8-10 |
| Void ratio (%) | 40-65 |
| Side compress strength (N/cm) | ≧100 |

When $3CaO.Fe_2O_3.6H_2O$ is used as the active component, the specifications and characteristics of the preferable catalyst are as follows:

| | |
|---|---|
| Appearance: | Strip shape, brown |
| Size (mm) | Φ2-4 × 5-25 |
| Bulk density (g/ml) | 1.1-1.2 |
| Specific surface area ($m^2$/g) | 1.8-10 |
| Void ratio (%) | 40-60 |
| Side compress strength (N/cm) | ≧80 |

In the above first embodiment, during the rectification, the mixture containing disulfides and LPG after the mercaptan conversion is fed into the rectification tower from bottom, wherein the inlet concentration of disulfides is 10 to 300 ppm, the tower bottom pressure is 0.3 to 2.1 MPa, the tower top pressure is 0.2 to 2.0 MPa, the tower bottom temperature is 60 to 130° C., the tower top temperature is 50 to 70° C., the reflux ratio is 2 to 9, and the reflux temperature is 25 to 45° C. After separation, the refined LPG product having no sulfur or a super-low level of sulfur (less than 1 ppm) is obtained at the tower top, and a mixture containing disulfides is obtained at the tower bottom wherein the content of disulfides is 10 wt % to 80 wt %.

The second embodiment of the present invention is similar to the above first embodiment, and the difference lies in that the rectification of the second embodiment comprises a preceding stage rectification and a subsequent stage rectification. The preceding stage rectification is identical to the rectification of the first embodiment, i.e., rectifying the mixture containing disulfides and LPG after the mercaptan conversion at the preceding stage rectification tower to obtain a refined LPG product at the tower top and a mixture containing disulfides at the tower bottom. The subsequent stage rectification comprises separating the mixture containing disulfides by the subsequent stage rectification tower to obtain disulfide products.

The operation conditions of the subsequent stage rectification include: feeding the mixture containing disulfides and LPG obtained from the bottom of the preceding stage rectification tower into the subsequent stage rectification tower from the bottom of the subsequent stage rectification tower for further separation, heating said mixture via reboiler with hot water or low pressure steam (having a gauge pressure of 0.1 to 0.6 MPa) as heat source, where the light components are vaporized and go up in the tower (the tower internals are trays or fillers), and with the heavy components in form of liquid left in the bottom of the tower, so as to separate gas and liquid, wherein the subsequent stage rectification tower has a tower bottom pressure of 0.15 to 1.9 MPa, a tower top pressure of 0.1 to 1.8 MPa, a tower bottom temperature of 60° C. to 110° C., a tower top temperature of 45° C. to 65° C., a reflux ratio of 2 to 6, and a reflux temperature of 25° C. to 45° C., and disulfide products having a purity of greater than 85% is obtained at the tower bottom of the subsequent stage rectification tower.

The third embodiment of the present invention is similar to the first embodiment, and the difference lies in that the fine desulfurization and mercaptan conversion are conducted in one fixed bed reactor; the fixed bed reactor is preferably a fixed bed reaction tower, and a solid desulfurizer bed and a solid catalyst bed are set on the fixed beds of the reaction tower; the inlet concentration of $H_2S$ of the LPG is less than or equal to 1000 ppm, preferably less than or equal to 100 ppm; the operation conditions of fine desulfurization and mercaptan conversion are that the temperature is 10° C. to 100° C., preferably from atmospheric temperature or 30° C. to 60° C., the pressure (gauge pressure) is 0.4 to 2.5 MPa, preferably 0.8 to 1.6 MPa, the liquid space rate is 0.5 to 1 $h^{-1}$, the total loading height of desulfurizer and catalyst is less than or equal to 10 m, and the ratio of height to diameter is 3:1 to 6:1. The LPG flows through the desulfurizer bed and the catalyst bed of the fixed bed reaction tower from bottom to top in turn. When the LPG flows through the desulfurizer bed, the resultants formed by reacting hydrogen sulfide with desulfurizer adhere on the desulfurizer so as to completely remove hydrogen sulfide therein. When the LPG flows through the catalyst bed, under the action of catalyst, an oxidation reaction takes place between the mercaptans in the LPG and the residual trace amount of air (or called as dissolved oxygen) in the LPG to form disulfides (thioethers), and said disulfides together with the LPG flow out of the fixed bed reactor.

The forth embodiment of the present invention is similar to the second embodiment, and the difference lies in that the fine desulfurization and mercaptan conversion are conducted in one fixed bed reactor; the fixed bed reactor is preferably a fixed bed reaction tower, and a solid desulfurizer bed and a solid catalyst bed above the desulfurizer bed are set on the fixed beds of the reaction tower; the inlet concentration of $H_2S$ of the LPG is less than or equal to 1000 ppm, preferably less than or equal to 100 ppm; the operation conditions of fine desulfurization and mercaptan conversion are that the temperature is 110° C. to 100° C., preferably from atmospheric temperature or 30° C. to 60° C., the pressure (gauge pressure) is 0.4 to 2.5 MPa, preferably 0.8 to 1.6 MPa, the liquid space rate is 0.5 to 1 $h^{-1}$, the total loading height of the desulfurizer and catalyst is less than or equal to 10 m, and the ratio of height to diameter is 3:1 to 6:1. The LPG flows through the desulfurizer bed and the catalyst bed of the fixed bed reaction tower from bottom to top in turn. When the LPG flows through the desulfurizer bed, the resultants formed by reacting hydrogen sulfide with desulfurizer adhere on the desulfurizer so as to completely remove hydrogen sulfide therein. When the LPG flows through the catalyst bed, under the action of catalyst, an oxidation reaction takes place between the mercaptans in the LPG and the residual trace amount of air (or called as dissolved oxygen) in the LPG to form disulfides (thioethers), and said disulfides together with the LPG flow out of the fixed bed reactor.

Compared with the prior art, the present invention has the following beneficial effects: (1) the process of the present invention for refining LPG absolutely abandons the traditional alkali treatment process, and uses only solid desulfurizer and catalyst for fine desulfurization and mercaptan conversion to fully achieve the object of complete desulfurization and mercaptan conversion, wherein the used solid desulfurizer and catalyst have relatively higher desulfurization efficiency and mercaptan-conversion efficiency, and the disulfides formed during the mercaptan conversion can be separated and recovered so as to simultaneously obtain the high quality LPG products and disulfide products. Thus, the process of the present invention has much simpler procedure, lower cost and higher economic benefit. And all reactions of said process need no organic base or inorganic base, which means that the present process is a really and totally alkali-free deodorization process, discharges no alkali sludge and makes no secondary pollution and is not harmful to environment and human health. (2) When converting the mercaptans in the LPG by the process of the present invention, under the action of catalyst, said mercaptans can be directly oxidized with "the dissolved oxygen" in the LPG to form disulfides and without feeding air or oxygen during oxidization, which meets the safety requirements in treatment of LPG. Whereas, the traditional technology comprises first absorbing and dissolving said mercaptans into a catalyst-containing alkali solution (sodium hydroxide solution) to form sodium mercaptides, then transferring sodium mercaptides via catalyst alkali solution into an oxidization tower, at the same time feeding air or oxygen to oxidize sodium mercaptides to disulfides, and regenerating alkali solution. Thus, the process of the present invention fundamentally alters the conventional mercaptan conversion process where air or oxygen must be fed for oxidization and regeneration, and the process of the present completely converts the mercaptans and solves the technical solution that is not solved for a long time. (3) The prior art neither discloses or mentions the fine desulfurization of LPG by using a fixed bed reaction process, wherein the formed sulfides adhere on the desulfurizer on the fixed bed, nor discloses or mentions the mercaptan conversion of LPG by using a fixed bed catalytic oxidization, wherein the mercaptans of LPG are directly converted into disulfides, which, however, are two main inventive points of the present invention. In addition, the prior art neither discloses or mentions the use of Fe—Ca oxide as effective components of desulfurizer for the desulfurization of LPG, nor discloses or mentions the use of Fe—Ca oxide hydrate as desulfurizer or the desulfurization of LPG by using said desulfurizer, nor discloses or mentions the use of Fe—Ca oxide or Fe—Ca oxide hydrate as active component of catalyst or the use of said catalyst for mercaptan conversion of LPG, nor discloses or mentions further separating the disulfides formed from the mercaptan conversion during refining LPG so as to obtain disulfide products having industrial or commercial values, which, however, are all further inventive points of the present invention over the prior art. (4) The present invention preferably uses two fixed bed reactors for conducting fine desulfurization and mercaptan convention of LPG respectively, which is valuable for the commercial-scale production. Since the effective component Fe—Ca oxide or Fe—Ca oxide hydrate is used as reactant in the reaction and thus has a relatively short period to invalidation (half year or more) during the fine desulfurization, while the active component Fe—Ca oxide or Fe—Ca oxide hydrate is used as catalyst in the reaction and thus has a relatively long period to invalidation (two years or more) during the mercaptan conversion, the replacement of desulfurizer and catalyst is thus facilitated by conducting fine desulfurization and mercaptan conversion in different fixed bed reactors. However, this does not mean that to conduct fine desulfurization and mercaptan in different sections of one fixed bed reactor is excluded from the protection scope of the present invention. In addition, since the desulfurizer of the present invention can convert mercaptans, and the catalyst for mercaptan conversion has function of fine desulfurization, the fine desulfurization and mercaptan conversion can be simultaneously carried out in the fixed bed desulfurization tower or the fixed bed catalytic reactor of a system having two fixed bed reactors by appropriately adjusting the related operation conditions, and then the treated LPG directly enters the rectification step. Thus, the spare fixed bed catalytic reactor can be saved for assembling the apparatus of the system. The aforesaid technical solutions of using one reactor for both fine desulfurization and mercaptan conversion all belong to the protection scope of the present invention. It should also be understood that the partial mercaptans of LPG might be converted in the reactor for fine desulfurization when the system uses two fixed bed reactors, which should also be included in the protection scope of the present invention.

THE BEST MODE FOR CARRYING OUT THE INVENTION

Figure 2:
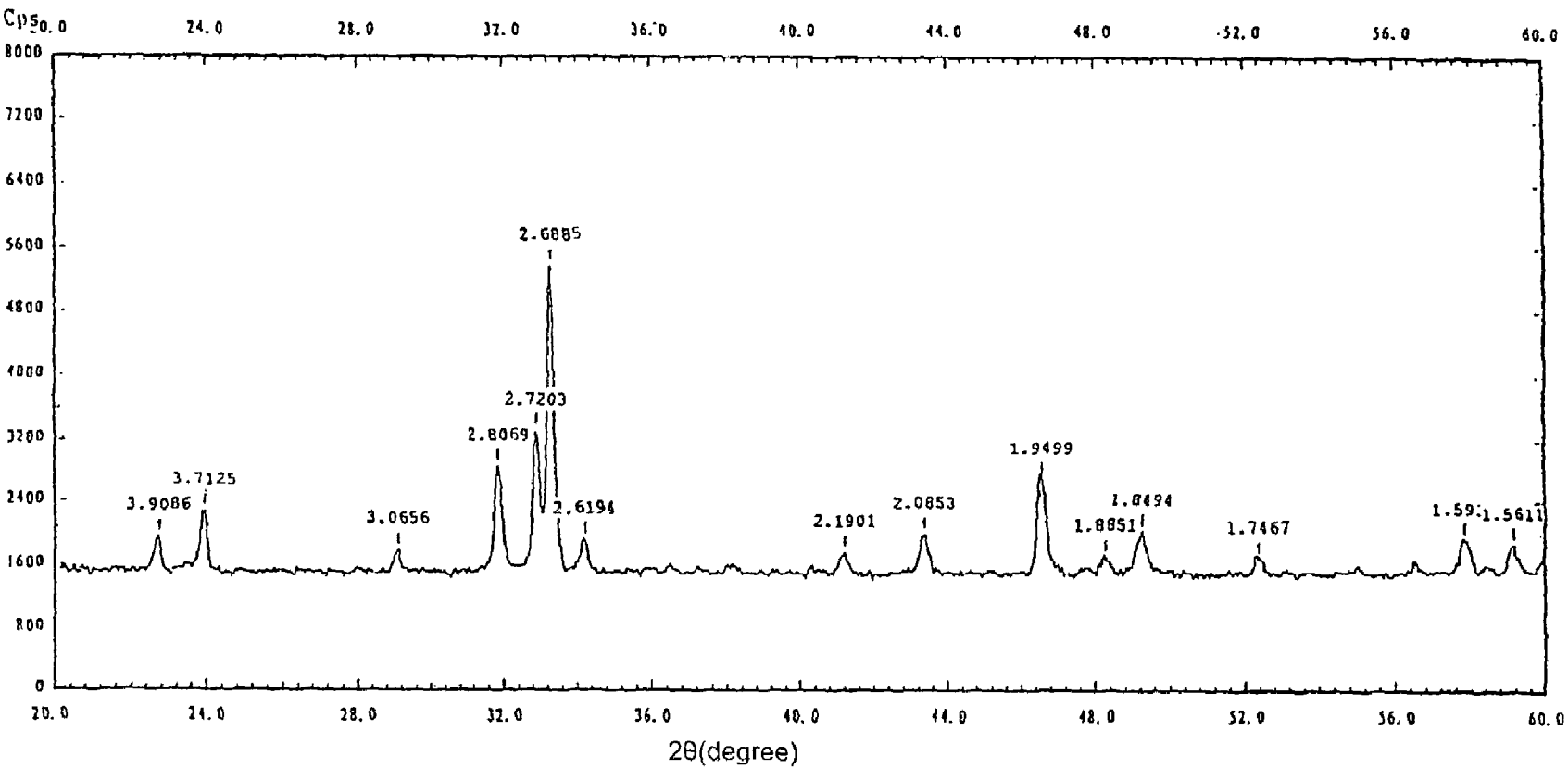
FIG. 2 is the X-ray diffraction pattern of a desulfurizer used in the present invention, wherein the effective component is $2CaO.Fe_2O_3$.

1. Preparation of desulfurizer T1 comprising Fe—Ca oxide as effective component. The desulfurizer comprising Fe—Ca oxide as effective component, especially the desulfurizer comprising $2CaO.Fe_2O_3$ as effective component, can be prepared by the following method comprising: (1) mixing the powder comprising ferric oxide and/or ferric hydroxide and/or ferric nitrate with the powder of calcium oxide and/or calcium hydroxide and/or calcium dicarbonate and/or calcium carbonate to form a mixture, wherein the molar ratio of iron to calcium is from 1:1 to 1:1.5, preferably from 1:1 to 1:1.2, more preferably from 1:1 to 1:1.05; (2) stirring the above mixture with water, molding and drying it; (3) calcinating the resultant of step (2) in oxidization atmosphere at 850-950° C. for 2-3 hours; and (4) cooling the resultant of step (3) to obtain the desulfurizer T1 comprising $2CaO.Fe_2O_3$ as effective component and having an appearance of chocolate brown or yellowish brown strip with a diameter of 3-5 mm and a length of 5-25 mm. The preferable desulfurizer has the following specifications and characteristics: specific surface area: 1.8-10 $m^2/g$, void ratio: 40-65%, bulk density: 1.0-1.1 $g/cm^2$, penetration sulfur capacity: ≧30 wt %, side compress strength: ≧100 N/cm. The X-ray diffraction pattern of the desulfurizer T1 is depicted in FIG. 2. As comparing with the X-ray diffraction pattern cards (J.C.P.D.S cards), the data of FIG. 2 show that the main component of said desulfurizer is $2CaO.Fe_2O_3$.

Figure 3:
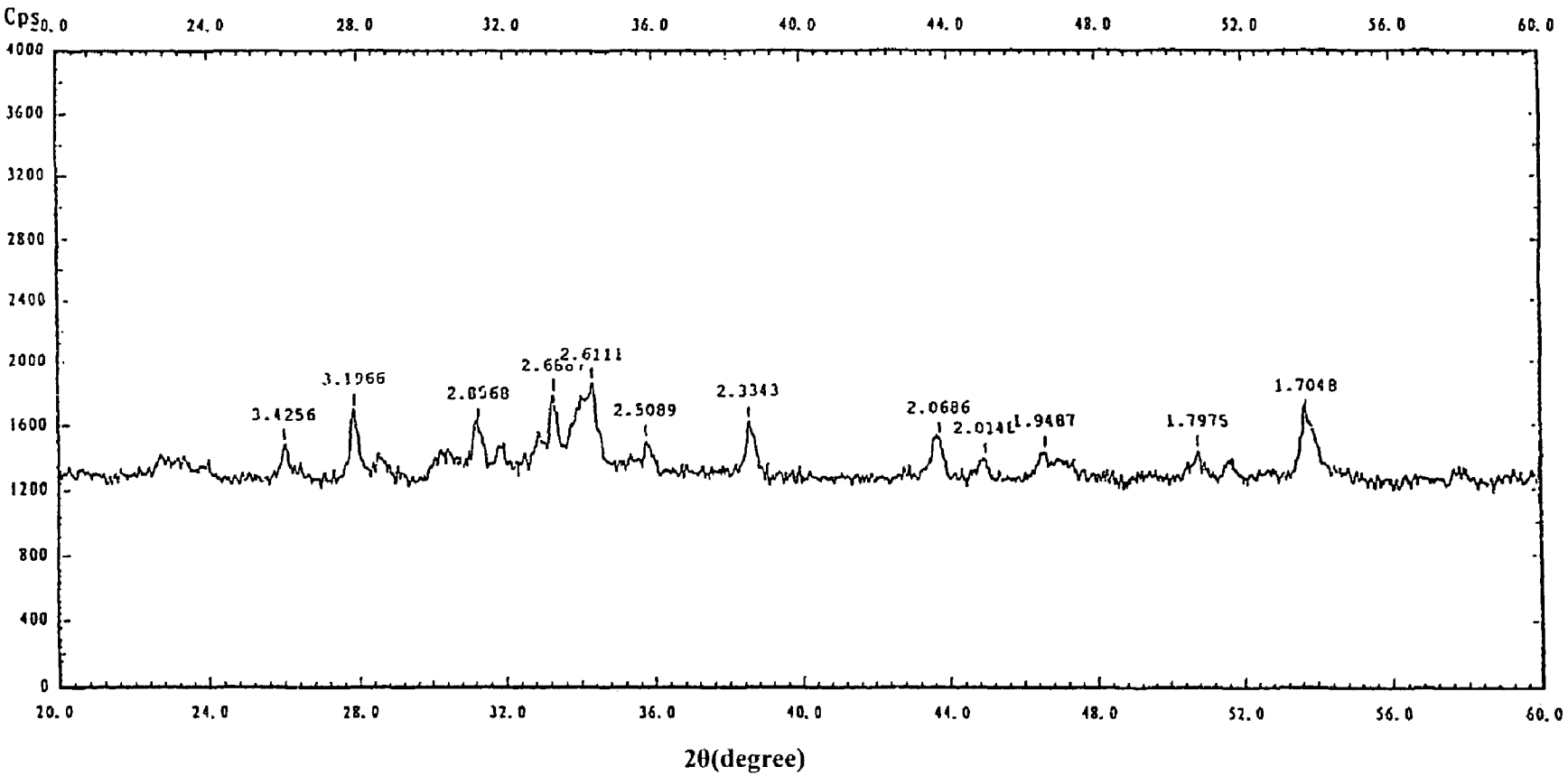
FIG. 3 is the X-ray diffraction pattern of another desulfurizer used in the present invention, wherein the effective component is $3CaO.Fe_2O_3.6H_2O$.

2. Preparation of desulfurizer T2 comprising Fe—Ca oxide hydrate as effective component. The desulfurizer comprising Fe—Ca oxide hydrate as effective component, especially the desulfurizer comprising $2CaO.Fe_2O_3.6H_2O$ as effective component, can be prepared by reacting water with the aforesaid desulfurizer comprising $2CaO.Fe_2O_3$ as effective component. The final product has an appearance of brown strip with a diameter of 2-4 mm and a length of 5-25 mm upon molding. The preferable desulfurizer T2 has the following specifications and characteristics: specific surface area: 1.8-10 $m^2/g$, void ratio: 40-60%, bulk density: 1.1-1.2 $g/cm^2$, penetration sulfur capacity: ≧30 wt %, side compress strength: ≧80 N/cm. The X-ray diffraction pattern of the desulfurizer T2 is depicted in FIG. 3. As comparing with the X-ray diffraction pattern cards (J.C.P.D.S cards), the data of FIG. 3 show that the main component of said desulfurizer is $2CaO.Fe_2O_3.6H_2O$.

3. Preparation of catalyst C1 comprising Fe—Ca oxide as active component. The method for preparation of the catalyst C1 is identical to the method for preparation of the desulfurizer comprising Fe—Ca oxide as effective component.

4. Preparation of catalyst C2 comprising Fe—Ca oxide hydrate as active component. The method for preparation of the catalyst C2 is identical to the method for preparation of the desulfurizer comprising Fe—Ca oxide hydrate as effective component.

5. Examples for refining LPG. The process of the present invention for refining LPG is further illustrated with the following examples, but the contents of the present invention are not restricted by these examples.

EXAMPLE 1

Figure 1:
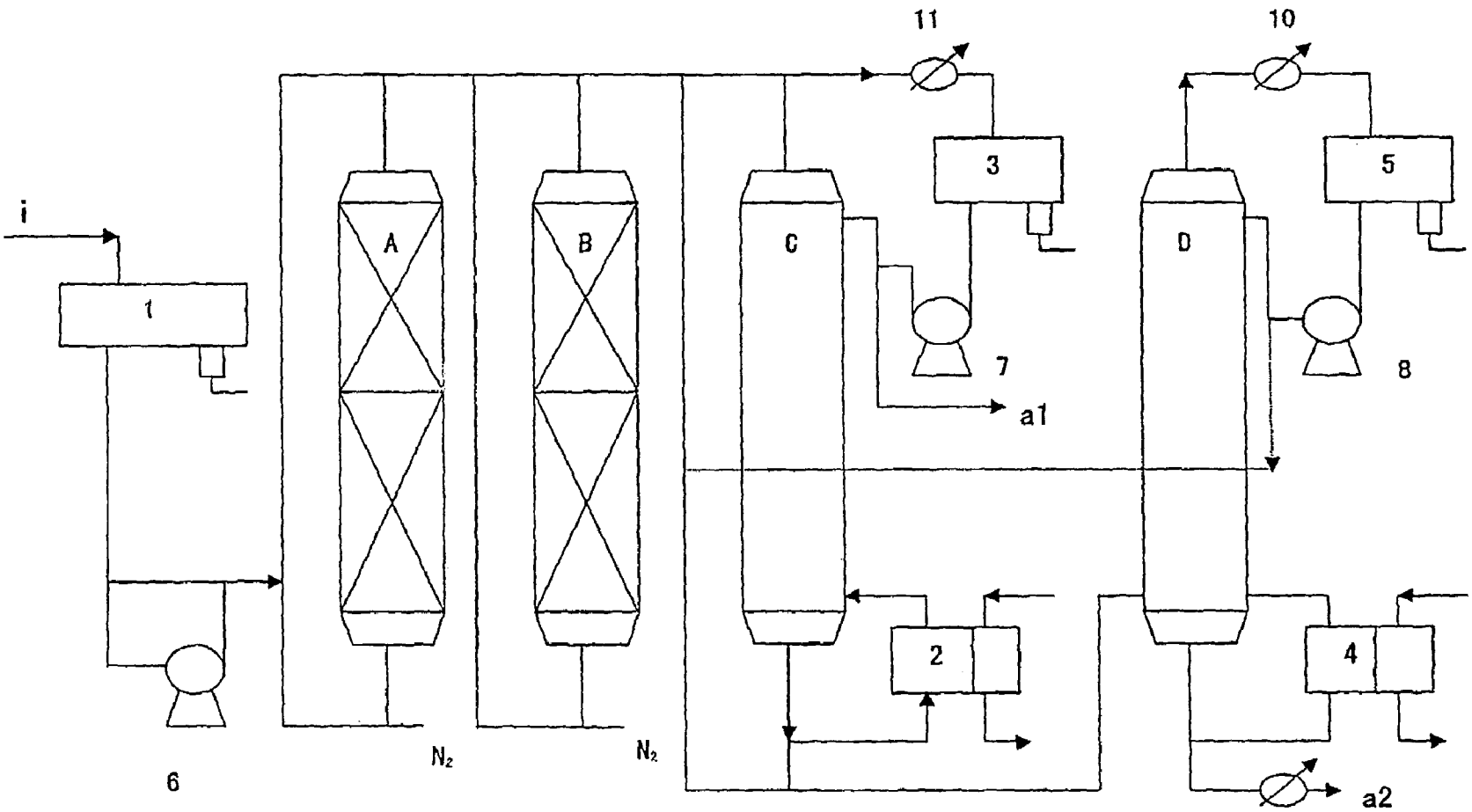
FIG. 1 is the schematic flow chart of the process of Example 1 of the present invention.

Referring to FIG. 1, this example refines LPG by using two fixed bed reactors respectively for fine desulfurization and mercaptan conversion and two stages rectification. In FIG. 1, A is a fixed bed fine desulfurization reactor (tower) for removing hydrogen sulfide; B is a fixed bed catalytic reactor/tower for catalytic oxidization and conversion of mercaptans into disulfides; C and D respectively are a preceding stage rectification tower and a subsequent stage rectification tower, wherein the preceding stage rectification tower is used for separating the disulfides in LPG, and the subsequent stage rectification tower is used for obtaining the disulfide products. In FIG. 1, 1 is a surge tank; 2 and 4 are reboilers; 3 and 5 are reflux tanks; 6, 7 and 8 are pumps; and 9, 10 and 11 are coolers. After the hydrogen sulfide of LPG is removed by ethanolamine (crude desulfurization), the LPG goes through the inlet i, and is treated through the flow chart consisting of A, B, C and D, and the qualified LPG end products and disulfide products are obtained at outlet a1 and outlet a2, respectively. If the pressure of the entered materials could meet the requirements, the surge tank may be unnecessary.

(1) Fine desulfurization: After the hydrogen sulfide of LPG is removed by ethanolamine, the LPG is first treated by the fixed bed desulfurization tower for fine desulfurization, wherein the used desulfurizer is T2. T2 comprises $3CaO.Fe_2O_3.6H_2O$ as effective component. The amount of $3CaO.Fe_2O_3.6H_2O$ is 85-95%, and the remaining component of T2 is calcium oxide. The bulk density of T2 is 1.15 $g/cm^3$. One or two layers of stainless steel wire mesh having a mesh diameter of less than 2 mm are set on the baffles fixed in the desulfurization tower; a layer of ceramics balls having a layer thickness of 200-300 mm and a ball diameter of 5-20 mm is laid on the wire mesh; the desulfurizer is loaded on the ceramics ball layer; one or two upper layers of ceramics balls having a layer thickness of 200-300 mm and a ball diameter of 5-20 mm are laid on the desulfurizer; and another layer of stainless steel wire mesh is set on the upper ceramics ball layer, so as to form the desulfurizer bed. The desulfurizer has a loading height of 7 meters, and a ratio of height to diameter of 5:1.

After the hydrogen sulfide of LPG is removed with ethanolamine, the LPG flows through the desulfurizer bed from bottom to top at atmospheric temperature, a pressure of 0.6-2.5 MPa, preferably 0.8-1.8 MPa, and a liquid space rate of 2 $h^{-1}$. The pressure suitable for apparatus may be preferably selected from the following three pressure ranges: 0.8-1.1 MPa, 1.1-1.4 MPa, and 1.4-1.8 MPa. The flow rate of LPG may be controlled according to the loading height, the ratio of height to diameter and the bulk density of the desulfurizer, and the liquid space rate of LPG. The flow rate should be equal to the product derived from multiplying the space volume occupied by the desulfurizer by the bulk density of the desulfurizer and by the liquid space rate of LPG, i.e., a value of 24.78 ton/h.

The LPG after being treated by this step has an amount of hydrogen sulfide less than 1 ppm. During the fine desulfurization, the resultants of the reaction between hydrogen sulfide and $Ca_2Fe_2O_5$ or $Ca_3(FeO_3)_2.6H_2O$ are mainly sulfur, ferrous sulfide and intergrowth product of ferrous sulfide and sulfur, and the resultants adhere on the desulfurizer so as to fully remove the hydrogen sulfide in the LPG. After running for a period of time, when hydrogen sulfide appears in the LPG after the fine desulfurization, that is, the desulfurizer becomes invalid, the invalid desulfurizer must be discharged. Before discharging the desulfurizer, the tower should be swept with nitrogen gas, and a suitable amount of water should be sprayed into the tower.

(2) Mercaptan conversion: The LPT after the fine desulfurization is fed into the above-mentioned subsequent stage fixed bed reactor for mercaptan conversion. The subsequent stage fixed bed reactor is a catalytic oxidization fixed bed reactor, wherein the used catalyst is the aforesaid catalyst C2. The catalyst C2 comprises $3CaO.Fe_2O_3.6H_2O$ as active component. The amount of $3CaO.Fe_2O_3.6H_2O$ is 85-95%, and the remaining component of C2 is calcium oxide. The bulk density of C2 is 1.15 $g/cm^3$. The structure of the catalyst bed is essentially identical to the structure of the desulfurizer bed indicated above. The liquid space rate (LHSV) is 2 $h^{-1}$. Since the flow rate of LPG discharged from the preceding stage fixed bed reactor is 24.78 ton/h, the present stage fixed bed reactor is determined to have a height of catalyst bed of 7 m, and a ratio of height to diameter of about 5. The temperature is atmospheric temperature, and the pressure is selected from the range of 0.5-2.3 MPa, and the exact pressure are determined according to the principle that the pressure of the present stage fixed bed reactor is slightly lower than that of the preceding stage fixed bed reactor (about 0.1-0.2 MPa lower), thus, the preferable pressure is 0.7-1.6 MPa. When the LPG flows through the catalyst fixed bed from bottom to top for mercaptan conversion, an oxidation reaction takes place between the mercaptans in the LPG and the residual trace amount of air (or called as dissolved oxygen) in the LPG to form disulfides (thioethers) under the action of catalyst, and said disulfides together with the LPG flow out of the fixed bed catalytic reactor. The LPG is free of mercaptans after passing though the catalyst bed, since the mercaptans are all converted into disulfides. After running for a period of mercaptan conversion, and when the LPG flowing out of the fixed bed catalytic reactor fails to pass the Doctor test or to pass the corrosion test of copper sheet, that is, the catalyst becomes inactivated, the inactivated catalyst must be discharged. Before discharging the catalyst, the tower should be swept with nitrogen gas, and a suitable amount of water should be sprayed into the tower.

(3) The preceding stage rectification to obtain the refined products of LPG: The LPG after the mercaptan conversion is treated by the preceding stage rectification, so as to separate LPG from the disulfides formed by the above conversion and thus to obtain the refined products of LPG and a materials containing disulfides. The LPG after the mercaptan conversion is fed into the preceding stage rectification tower from the tower bottom. The materials at its inlet have a content of disulfides of 80 ppm. The tower bottom pressure of the preceding stage rectification tower is slightly lower than the pressure of the subsequent stage fixed bed reactor, and is 0.3-2.1 MPa, preferably 0.6-1.5 MPa, and the tower top pressure is 0.1 MPa lower than the tower bottom pressure, and is 0.2-2.0 Mpa, preferably 0.5-1.4 MPa. The tower bottom temperature is about 110° C.; the tower top temperature is about 55° C.; the reflux ratio is 2-9; and the reflux temperature is 25-45° C., preferably 30-40° C. After separation, the refined LPG product having no sulfur or a super-low level of sulfur (less than 1 ppm) is obtained at the tower top, and a mixture containing disulfides and LPG is obtained at the tower bottom.

(4) The subsequent stage rectification to obtain the disulfide products: The mixture containing disulfides and LPG discharged from the tower bottom of the preceding stage rectification tower is fed into the subsequent stage rectification tower from the bottom of the subsequent stage rectification tower. The materials at its inlet have disulfide content of 30%. The tower bottom pressure of the subsequent stage rectification tower is 0.15-1.9 MPa, preferably 0.5 MPa, lower than the tower top pressure of the preceding stage rectification tower, and the tower top pressure is 0.1-1.8 Mpa, preferably 0.4 MPa, slightly lower than the tower bottom pressure. The tower bottom temperature is about 100° C.; the tower top temperature is about 50° C.; the reflux ratio is 2-6; and the reflux temperature is 25-45° C., preferably 30-40° C. After separation, the disulfide products having a purity of about 90% are obtained at the tower bottom.

During the aforesaid steps of the present example, the related operation parameters are determined according to the following principles: (1) the material flows shall be in a balanced state, for example, the flow rates of LPG shall be essentially the same in each step; and (2) in the case that there is not a booster pump assembled in the system, the pressure of apparatus in a stage shall not be greater than the pressure of apparatus in its preceding stage. The other examples of the present invention shall also be in conformity with these principles.

EXAMPLE 2

Example 2 is similar to Example 1, and the difference lies in that: the desulfurizer T2 used in the fine desulfurization comprises 91-95% $3CaO.Fe_2O_3.6H_2O$ as effective component, with the main remaining component being calcium oxide, and has a bulk density of 1.2 g/cm$^3$. The selected operation conditions are as follows:

(1) The temperature is 10-30° C.; the selectable pressure range is 0.8-1.1 MPa; the liquid space rate is 1 h$^{-1}$; the loading height of desulfurizer is 7.49 m; and the ratio of height to diameter is 4:1.

(2) The temperature is 30-50° C.; the selectable pressure range is 1.1-1.4 MPa; the liquid space rate is 1.5 h$^{-1}$; the loading height of desulfurizer is 7.60 m; and the ratio of height to diameter is 5:1.

(3) The temperature is 60-100° C.; the selectable pressure range is 1.4-1.8 MPa; the liquid space rate is 2 h$^{-1}$; the loading height of desulfurizer is 7.79 m; and the ratio of height to diameter is 6:1.

EXAMPLE 3

Example 3 is similar to Example 1, and the difference lies in that: the desulfurizer T1 used in the fine desulfurization comprises 91-95% $2CaO.Fe_2O_3$ as effective component, with the main remaining component being calcium oxide, and has a bulk density of 1.1 g/cm$^3$. The reaction between the hydrogen sulfide in the LPG and $2CaO.Fe_2O_3$ produces sulfur and a mixture of ferrous sulfide and $Fe_7S_8$, and these resultants adhere on the desulfurizer. The selected operation conditions are as follows:

(1) The temperature is 10-30° C.; the selectable pressure range is 0.8-1.1 MPa; the liquid space rate is 1 h$^{-1}$; the loading height of desulfurizer is 7.71 m; and the ratio of height to diameter is 4:1.

(2) The temperature is 30-50° C.; the selectable pressure range is 1.1-1.4 MPa; the liquid space rate is 1.5 h$^{-1}$; the loading height of desulfurizer is 7.82 m; and the ratio of height to diameter is 5:1.

(3) The temperature is 60-1,00° C.; the selectable pressure range is 1.4-1.8 MPa; the liquid space rate is 2 h-1; the loading height of desulfurizer is 8.02 m; and the ratio of height to diameter is 6:1.

EXAMPLE 4

Example 4 is similar to Example 1, and the difference lies in that: the catalyst C2 used in the mercaptan conversion comprises 91-95% $3CaO.Fe_2O_3.6H_2O$ as active component, with the main remaining component being calcium oxide, and has a bulk density of 1.2 g/cm$^3$. The selected operation conditions are as follows:

(1) The temperature is 10-30° C.; the selectable pressure range is 0.7-1.0 MPa; the liquid space rate is 2.5 h$^{-1}$; the loading height of desulfurizer is 5.52 m; and the ratio of height to diameter is 4:1.

(2) The temperature is 30-50° C.; the selectable pressure range is 1.0-1.3 MPa; the liquid space rate is 3.0 h$^{-1}$; the loading height of desulfurizer is 6.03 m; and the ratio of height to diameter is 5:1.

(3) The temperature is 60-100° C.; the selectable pressure range is 1.3-1.6 MPa; the liquid space rate is 3.5 h$^{-1}$; the loading height of desulfurizer is 6.47 m; and the ratio of height to diameter is 6:1.

EXAMPLE 5

Example 5 is similar to Example 1, and the difference lies in that: the catalyst C1 used in the mercaptan conversion comprises 91-95% $2CaO.Fe_2O_3$ as active component, with the main remaining component being calcium oxide, and has a bulk density of 1.1 g/cm$^3$. The selected operation conditions are as follows:

(1) The temperature is 10-30° C.; the selectable pressure range is 0.7-1.0 MPa; the liquid space rate is 1.5 h$^{-1}$; the loading height of desulfurizer is 6.73 m; and the ratio of height to diameter is 4:1.

(2) The temperature is 30-50° C.; the selectable pressure range is 1.0-1.3 MPa; the liquid space rate is 2.5 h$^{-1}$; the loading height of desulfurizer is 6.59 m; and the ratio of height to diameter is 5:1.

(3) The temperature is 60-100° C.; the selectable pressure range is 1.3-1.6 MPa; the liquid space rate is 3.0 h$^{-1}$; the loading height of desulfurizer is 7.01 m; and the ratio of height to diameter is 6:1.

EXAMPLE 6

Example 6 is similar to Example 1, and the difference lies in that: during the rectification, the preceding stage rectification tower has a tower bottom pressure of about 0.5 MPa, a tower top pressure of about 0.4 MPa, a tower bottom temperature of about 60° C., and a tower top temperature of about 50° C.; and the subsequent stage rectification tower has a tower bottom pressure of about 0.2 MPa, a tower top pressure of about 0.1 MPa, a tower bottom temperature of about 60° C., and a tower top temperature of about 45° C. The pressure of apparatus in the corresponding mercaptan conversion is 0.7 MPa, and the pressure of apparatus in the corresponding fine desulfurization is 0.8 MPa.

EXAMPLE 7

Example 7 is similar to Example 1, and the difference lies in that: during the rectification, the preceding stage rectification tower has a tower bottom pressure of about 2.0 MPa, a tower top pressure of about 1.9 MPa, a tower bottom temperature of about 130° C., and a tower top temperature of about 70° C.; and the subsequent stage rectification tower has a tower bottom pressure of about 1.0 MPa, a tower top pressure of about 0.8 MPa, a tower bottom temperature of about 110° C., and a tower top temperature of about 65° C. The pressure of apparatus in the corresponding mercaptan conversion is 2.2 MPa, and the pressure of apparatus in the corresponding fine desulfurization is 2.4 MPa.

EXAMPLE 8

Example 8 is similar to one of examples 1 to 7, and the difference lies in that: the mixture containing disulfides discharged from the preceding stage rectification tower is treated by another method, rather than with the subsequent stage rectification tower. The refined product of LPG is directly obtained only at outlet a1.

EXAMPLE 9

Example 9 is similar to Example 1, and the difference lies in that: the fine desulfurization and the mercaptan conversion are conducted in one fixed bed reactor, and the fixed bed reactor is preferably a fixed bed reaction tower, wherein the solid catalyst bed (both as desulfurizer for fine desulfurization and as catalyst bed for mercaptan conversion) comprising $3CaO.Fe_2O_3.6H_2O$ as both effective component and active component is set on the fixed bed in the reaction tower. The inlet concentration of hydrogen sulfide in the LPG is less than or equal to 1000 ppm, preferably less than or equal to 100 ppm. The operation conditions for fine desulfurization and mercaptan conversion are: temperature: 10-100° C., preferably from atmospheric temperature or 30 to 60° C.; pressure (gauge pressure): 0.4-2.5 MPa, preferably 0.8-1.6 MPa; liquid space rate: 0.5-1 h$^{-1}$; loading height of the desulfurizer (also as catalyst): less than or equal to 10 m; and ratio of height to diameter: 3:1 to 6:1. The LPG flows through the desulfurizer (also as catalyst) bed of the fixed bed reaction tower from bottom to top, wherein the resultants formed by the reaction between hydrogen sulfide and the desulfurizer (also as catalyst) adhere on the lower half of said bed so as to fully remove the hydrogen sulfide in the LPG, when the LPG passes through the lower half of said bed; and an oxidation reaction takes place between the mercaptans in the LPG and the residual trace amount of air in the LPG to form disulfides under the action of desulfurizer (also as catalyst), when the LPG passes through the upper half of said bed, and said disulfides together with the LPG flow out of the fixed bed catalytic reactor.

EXAMPLE 10

Example 10 is similar to Example 9, and the difference lies in that: the fine desulfurization and the mercaptan conversion are conducted in one fixed bed reactor tower having layered beds. The desulfurizer bed for fine desulfurization is fixed in the lower section of the reactor tower and has $3CaO.Fe_2O_3.6H_2O$ as effective component, and the catalyst bed for mercaptan conversion is fixed in the upper section of the reactor tower and has $3CaO—Fe_2O_3.6H_2O$ as active component. The LPG flows through the desulfurizer bed and catalyst bed of the fixed bed reaction tower from bottom to top in turn, wherein the resultants formed by the reaction between hydrogen sulfide and the desulfurizer adhere on the desulfurizer so as to fully remove the hydrogen sulfide in the LPG, when the LPG passes through the desulfurizer bed; and an oxidation reaction takes place between the mercaptans in the LPG and the residual trace amount of air in the LPG to form disulfides under the action of catalyst, when the LPG passes through the catalyst bed, and said disulfides together with the LPG flow out of the fixed bed catalytic reactor.

What is claimed is:

1. A process for refining liquefied petroleum gas in a commercial scale, comprising:

in the absence of alkali, passing the liquefied petroleum gas after alcohol amino treatment through a desulfurizer comprising an effective component selected from the group consisting of a Fe—Ca oxide and a Fe—Ca oxide hydrate for performing fine desulfurization, and a catalyst set in a fixed bed reactor comprising an active component selected from the group consisting of a Fe—Ca oxide and a Fe—Ca oxide hydrate for performing mercaptan conversion, wherein hydrogen sulfide in the liquefied petroleum gas reacts with the effective component and the resultants adhere on the desulfurizer during the fine desulfurization, and mercaptans in the liquefied petroleum gas react with residual trace amount of air in the liquefied petroleum gas under the action of the catalyst to form disulfides during the mercaptan conversion;

flowing the formed disulfides together with the liquefied petroleum gas out of the fixed bed reactor; and treating the liquefied petroleum gas after mercaptan conversion by rectification to obtain a refined liquefied petroleum gas product.

2. A process for refining liquefied petroleum gas in a commercial scale according to claim 1, wherein the Fe—Ca oxide is $2CaO.Fe_2O_3$, and the Fe—Ca oxide hydrate is $3CaO.Fe_2O_3.6H_2O$; and during the fine desulfurization, the resultants of the reaction between hydrogen sulfide and $Ca_2Fe_2O_5$ or $Ca_3(FeO_3)_2.6H_2O$ are mainly sulfur, ferrous sulfide and intergrowth product of ferrous sulfide and sulfur.

3. A process for refining liquefied petroleum gas in a commercial scale according to claim 2, wherein the effective component in the desulfurizer is present in an amount of 80-100% based on the total weight of the desulfurizer, and the active component in the catalyst is present in an amount of 80-100% based on the total weight of the catalyst.

4. A process for refining liquefied petroleum gas in a commercial scale according to claim 3, wherein the amount of the effective component in the desulfurizer is 91-95%, and the remaining component is mainly calcium oxide; and the amount of the active component in the catalyst is 91-95%, and the remaining component is mainly calcium oxide.

5. A process for refining liquefied petroleum gas in a commercial scale according to claim 1, wherein:

the fine desulfurization and mercaptan conversion are conducted in different preceding stage and subsequent stage fixed bed reactors;

the liquefied petroleum gas after alcohol amine treatment first enters the preceding stage fixed bed reactor with a desulfurizer bed, where the liquefied petroleum gas passes through the desulfurizer bed from bottom to top for the fine desulfurization;

the liquefied petroleum gas after the fine desulfurization enters into the subsequent stage fixed bed reactor with a catalyst bed, where the liquefied petroleum gas passes through the catalyst bed from bottom to top for the mercaptan conversion; and a mixture containing the disulfides and the liquefied petroleum gas after the mercaptan conversion is separated by a rectification tower to obtain the refined liquefied petroleum gas product from the tower top and the mixture containing the disulfides from the tower bottom.

6. A process for refining liquefied petroleum gas in a commercial scale according to claim 5, wherein:

during the fine desulfurization, the liquefied petroleum gas has an inlet concentration of hydrogen sulfide that is less than or equal to 1000 ppm;

the fine desulfurization is operated under operation conditions comprising a temperature of 10-100° C., a gauge pressure of 0.4-2.5 MPa, a liquid space rate of 1-2 $h^{-1}$, a loading height of desulfurizer of less than or equal to 10 m, and a ratio of height to diameter of from 3:1 to 6:1;

the mercaptan conversion is operated under operation conditions comprising a temperature of 0-100° C., a gauge pressure of 0.4-2.3 MPa, a liquid space rate of 1-4 $h^{-1}$ , a loading height of catalyst of less than or equal to 10 m, and a ratio of height to diameter of from 3:1 to 6:1;

during the rectification, the mixture after the mercaptan conversion is fed into the rectification tower from the tower bottom, and said rectification tower has a tower bottom gauge pressure of 0.3-2.1 MPa, a tower top gauge pressure of 0.2-2.0 MPa, a tower bottom temperature of 60-130° C., a tower top temperature of 50-70° C., a reflux ratio of 2-9, and a reflux temperature of 30-40° C.; and after separation, the refined liquefied petroleum gas products having no sulfur or a super-low level of sulfur is obtained at the tower top, and a mixture containing the disulfides is obtained at the tower bottom.

7. A process for refining liquefied petroleum gas in a commercial scale according to claim 6, wherein:

during the fine desulfurization, the liquefied petroleum gas has an inlet concentration of hydrogen sulfide that is less than or equal to 1000 ppm, and; the operation conditions comprise a temperature of from atmospheric temperature or 30 to 60° C., and a gauge pressure of 0.8-1.8 MPa;

during the mercaptan conversion, the operation conditions comprise a temperature of from atmospheric temperature or 30 to 60° C., and a gauge pressure of 0.7-1.6 MPa; and during the rectification, the content of disulfides in the mixture after the mercaptan conversion is 10-300 ppm.

8. A process for refining liquefied petroleum gas in a commercial scale according to claim 1, wherein:

the fine desulfurization and mercaptan conversion are conducted in different preceding stage and subsequent stage fixed bed reactors;

the liquefied petroleum gas after alcohol amine treatment first enters the preceding stage fixed bed reactor with a desulfurizer bed, where the liquefied petroleum gas passes through the desulfurizer bed from bottom to top for the fine desulfurization;

the liquefied petroleum gas after the fine desulfurization enters into the subsequent stage fixed bed reactor with a catalyst bed, where the liquefied petroleum gas passes through the catalyst bed from bottom to top for the mercaptan conversion;

the rectification comprises a preceding stage rectification and a subsequent stage rectification, wherein the preceding stage rectification comprises separating a mixture containing the disulfides and the liquefied petroleum gas after the mercaptan conversion by a rectification tower of the preceding stage rectification to obtain a refined liquefied petroleum gas product at the tower top and a mixture containing disulfides at the tower bottom; and the subsequent stage rectification comprises separating the mixture containing the disulfides by a rectification tower of the subsequent stage rectification to obtain disulfide products at the tower bottom.

9. A process for refining liquefied petroleum gas in a commercial scale according to claim 8, wherein:

during the fine desulfurization, the liquefied petroleum gas has an inlet concentration of hydrogen sulfide that is less than or equal to 1000 ppm; the fine desulfurization is operated under operation conditions comprising a temperature of 10-100° C., a gauge pressure of 0.4-2.5 MPa, a liquid space rate of 1-2 $h^{-1}$, a loading height of desulfurizer of less than or equal to 10 m, and a ratio of height to diameter of from 3:1 to 6:1;

the mercaptan conversion is operated under operation conditions comprising a temperature of 0-100° C., a gauge pressure of 0.4-2.3 MPa, a liquid space rate of 1-4 $h^{-1}$, a loading height of catalyst of less than or equal to 10 m, and a ratio of height to diameter of from 2:1 to 6:1;

during the preceding stage rectification, the mixture after the mercaptan conversion is fed into the preceding stage rectification tower from the tower bottom, and said preceding stage rectification tower has a tower bottom gauge pressure of 0.3-2.1 MPa, a tower top pressure of 0.2-2.0 MPa, a tower bottom temperature of 60-130° C., a tower top temperature of 50-70° C., a reflux ratio of 2-9, and a reflux temperature of 25-45° C.;

after separation, the refined liquefied petroleum gas products having no sulfur or a super-low level of sulfur are obtained at the tower top; the mixture containing the disulfides and the liquefied petroleum gas discharged from the tower bottom of the preceding stage rectification tower is fed into the subsequent stage rectification tower from the tower bottom;

during the subsequent stage rectification, the content of disulfides in the materials is 10-80 wt %, and the subsequent stage rectification tower has a tower bottom gauge pressure of 0.15-1.9 MPa, a tower top gauge pressure of 0.1-1.8 MPa, a tower bottom temperature of 60-110° C., a tower top temperature of 45-65° C., a reflux ratio of 2-6, and a reflux temperature of 25-45° C.; and the disulfide products of a purity of ≧85% are obtained at the bottom of the subsequent stage rectification tower.

10. A process for refining liquefied petroleum gas in a commercial scale according to claim 9, wherein:

during the fine desulfurization, the inlet concentration of hydrogen sulfide in the liquefied petroleum gas is less than or equal to 1000 ppm, and; the operation conditions comprises a temperature of from atmospheric temperature or 30 to 60° C., and a gauge pressure of 0.8-1.8 MPa;

during the mercaptan conversion, the operation conditions comprise a temperature of from atmospheric temperature or 30 to 60° C., and a gauge pressure of 0.7-1.6 MPa; and during the rectification, the content of disulfides in the mixture after the mercaptan conversion is 10-300 ppm.

* * * * *